US005663607A

United States Patent [19]

Kira et al.

[11] Patent Number: 5,663,607

[45] Date of Patent: Sep. 2, 1997

[54] DISCHARGE LAMP LEAD SUPPORT

[75] Inventors: Takehiro Kira; Takanori Serizawa, both of Himeji, Japan

[73] Assignee: Ushiodenki Kabushiki Kaisha, Tokyo, Japan

[21] Appl. No.: 496,476

[22] Filed: Jun. 29, 1995

[30] Foreign Application Priority Data

Jun. 29, 1994 [JP] Japan ..... 6-168696

[51] Int. Cl.[6] ..... H01J 1/96

[52] U.S. Cl. ..... 313/284; 313/252; 313/623

[58] Field of Search ..... 313/623, 252, 313/253, 284, 292, 626, 267, 287

[56] References Cited

U.S. PATENT DOCUMENTS 4,038,578 7/1977 Mathijssen ..... 313/623
4,463,281 7/1984 Triebel et al. ..... 313/623
5,369,329 11/1994 Austad et al. ..... 313/623

FOREIGN PATENT DOCUMENTS 3029824 3/1982 Germany .

*Primary Examiner*—Sandra L. O'Shea
*Assistant Examiner*—Matthew J. Esserman
*Attorney, Agent, or Firm*—Sixbey, Friendman, Leedom & Ferguson, P.C.; David S. Safran

[57] ABSTRACT

A discharge lamp having an emission part with a roughly spherical external shape and tube arms extending from opposite sides of the emission part, hermetically sealing parts formed on an end of each robe arm, and a lead pin extending parallel to a longitudinal axis of the tube arm, a tip of each lead carrying an electrode in the emission part, so that a pair of electrodes are arranged opposite one another in the emission part. Within each babe arm, in the vicinity of the emission part, a plate-shaped holding part which is made of a metal with a high melting point and through which the lead pin penetrates, is arranged roughly perpendicularly to the lead pin and serves for positioning of the electrodes.

4 Claims, 2 Drawing Sheets

DISCHARGE LAMP LEAD SUPPORT

BACKGROUND OF THE INVENTION

1. Field of the Invention

The invention relates to a discharge lamp.

2. Description of the Prior Art

Discharge lamps are, for the most part, divided into lamps of the short arc type with a small distance between a cathode and an anode and into lamps of the long arc type with a large distance between the cathode and anode. A xenon lamp and a mercury high pressure lamp are known short arc lamps.

A short arc lamp, generally, is comprised of a roughly spherical emission part and tube arms located on both ends of the emission part. In the interior of the emission part is a pair of electrodes which are spaced a predetermined distance apart, and within the tube arm are a lead pin and a metal foil.

In the production of a lamp, it is necessary for purposes of encapsulation of a desired gas in the emission part, to install a gas tube which is used especially for this purpose. Since the tube arm, however, undergoes processing under heat, it is difficult to install the gas tube therein. The gas tube is, therefore, generally installed in one part of the emission part, and the gas is introduced and encapsulated in the emission part through this gas tube. After encapsulation, the gas tube is removed from the emission part. In this way, the desired gas can be encapsulated in the emission part and a hermetically sealed arrangement of the emission part can be obtained in which the encapsulated gas does not leak, and at the same time, in the tube arm, there can be a lead pin as a power supply lead and a metal foil.

However, it is difficult to completely remove the gas tube from the surface of the emission part. There always remains a residue of the gas tube on the surface of the emission part. This residue generally has a size of roughly a few millimeters; however, this residue produces refraction of light radiated from the emission part, and it can appear on an irradiated surface as a shadow. Therefore, the presence of a gas tube residue can become an obstacle, depending on the applications. In particular, in the case where the emission part is used as a light source of a projector, it is a major disadvantage that the residue occurs on an image screen as a shadow. Furthermore, in the quartz glass of the emission part, distortion of the glass occurs, since the gas tube is heat treated upon its removal. In the case in which this distortion is large, the emission part can break during luminous operation of the lamp.

On the other hand, to prevent the formation of a shadow on the image screen the lamp can be arranged with consideration of the positional relation to the screen. This process is, however, not especially desirable since it takes a long time for the lamp to be installed, and furthermore, since projector lamps are frequently replaced.

Based on the above described circumstances there is a need for a lamp in which there is no gas tube residue on the emission part.

On the other hand, a lamp is also already known in which the gas tube through which the gas is introduced and encapsulated is installed in one part of the tube arm. By means of this type of lamp, the above described disadvantage is eliminated, since there is no gas tube residue on the emission part.

In this lamp, it is necessary to provide a cavity which is connected to the inside of the emission part within the tube arm. In this case, therefore, it is not possible to obtain a hermetically sealed arrangement by melting the quartz glass at the base of the emission part.

In an arrangement in which the entire inner sides of the emission part and the tube and are formed as a cavity, and in which a lead is held only from one end of the tube arm, it is difficult to arrange the electrodes in the desired position as the result of the weight of the lead and the electrodes. Furthermore, holding of the lead is destroyed by vibrations and impacts in the transport of the lamp.

Therefore, a process is also known in which a part used in the tube arm especially for holding the lead in order to place the electrodes in the desired position. However, in this process the size of the gas passage is limited, and the arrangement of this holding part in the lamp with a hermetically sealed arrangement is not easily obtained.

Use of a perforated glass sphere is described as a process for holding the lead pin in German patent P 3029824.9. This perforated glass sphere is located within the tube arm in the vicinity of the emission part and is provided in part with an opening through which the gas can be discharged. This arrangement, however, has the following disadvantages:

The part which holds the lead consists of glass. However, processing thereof is not easily performed since the size thereof must be roughly the same as the inside diameter of the pipe arm, and since a gas passage opening is necessary.

The perforated sphere consists of the same glass as the emission part. In lamp production, therefore, cracks easily occur in the emission part or in the perforated sphere.

Furthermore, a pressing device is necessary to press the perforated sphere onto the side of the emission part. At the same time, there is the disadvantage that this pressing device is also heated as the temperature of the lamp rises, and under certain circumstances, loses its function due to deformation:

If between the cross sectional middle of the robe arm and the cross sectional middle of the perforated sphere there is a fault, the position of the electrodes deviates from the desired position. When used over a long time, polarization of the electrodes occurs which can also be designated as concentration or accumulation on a certain side and wearing of the electrodes takes place; this causes unstable are discharge.

SUMMARY OF THE PRESENT INVENTION

Therefore, the primary object of the present invention is to devise a discharge lamp in which a gas tube is installed, not in an emission part, but in tube arms located on each end of the emission part; in the gas tube, at the same time, in the tube arm, there is a plate-shaped holding part formed of a metal with a high melting point, and a lead is held by this holding part.

The noted object is achieved, according to the invention, by the fact that, in a discharge lamp with an emission part having an external shape that is roughly spherical, tube arras connected to both sides of this emission part, and hermetically sealing parts which are formed on one end of each tube arm, in which the hermetically sealing part is penetrated from the outside by a lead pin which extends within the tube arm parallel to its longitudinal direction, and the lead pin has an electrode on a tip end thereof within the emission part, the emission part containing a pair of opposed, spaced apart electrodes. Moreover, on each side of the emission part, within a respective tube arm, a plate-shaped holding part made of a metal with a high melting point is provided and through which the lead pin penetrates and is held roughly perpendicularly thereto for positioning of the electrodes.

The object is furthermore achieved according to the invention by the fact that the above described holding part is a polygon with corner points which contact the inside of the respective tube arm, and that, at the same time, a gas passage is formed through a gap formed between each side of the holding part and the inside of the respective tube arm. More specifically, the corner points of the polygonal holding part are bent towards the hermetically sealing part and it is this bent part that contacts the inside of the tube arm.

Achieving of the above object is further facilitated by the fact that in a part of the holding part through which the lead pin penetrates, at each side of the plate-shaped holding part, there is a helical part with which the position of holding part relative to the lead is fixed.

DETAILED DESCRIPTION OF THE PREFERRED EMBODIMENT

Figure 1:
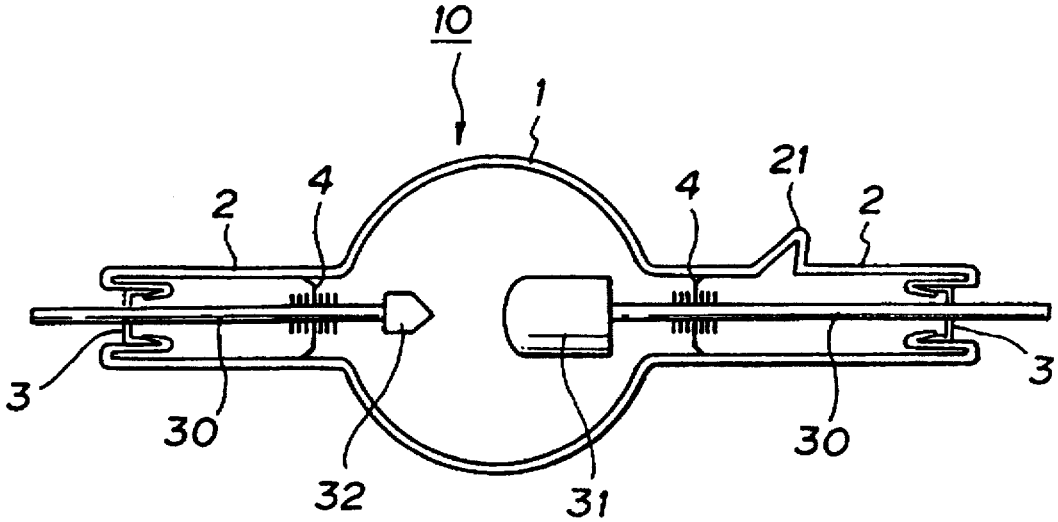
FIG. 1 is a schematic representation of a discharge lamp according to a preferred embodiment of the invention.

The discharge lamp 10 according to the invention shown in FIG. 1 is comprised of a roughly spherical emission part 1 which is made of quartz glass and from which roughly cylindrical tube arms 2 extend on opposite sides of the emission part 1. Emission part 1 and tube arms 2 are conventionally produced by hot forming of a glass tube and have a one-piece construction. Hermetically sealing parts 3 close the opening present at the free end of each of the tube arms 2. A gas tube residue 21 is present on part of one tube arm 2. This residue 21 remains after removal of the gas tube by which gas is introduced and encapsulated during manufacturing of the lamp 10. Electrical lead 30 extends through the hermetically sealing parts 3. An anode 31 and a cathode 32 are installed within the emission part 1 on an inner end of a respective lead 30.

A holding part 4 is located in each tube arm 2, in the vicinity of emission part 1, for retaining lead 30. Holding part 4 is, for example, a square molybdenum plate with edges which are bent. For this reason, instead of molybdenum, the plate can be made of a metal with a high melting point, such as tantalum or the like. Likewise, the rectangular shape shown is not essential, and other shapes can be used. In the manufacture of the lamp or in luminous operation of the lamp, however, a high melting point is necessary as the result of the very high temperature of the lamp. Specifically, a metal with a melting point of at least 1000° C. is desirable.

Figure 2:
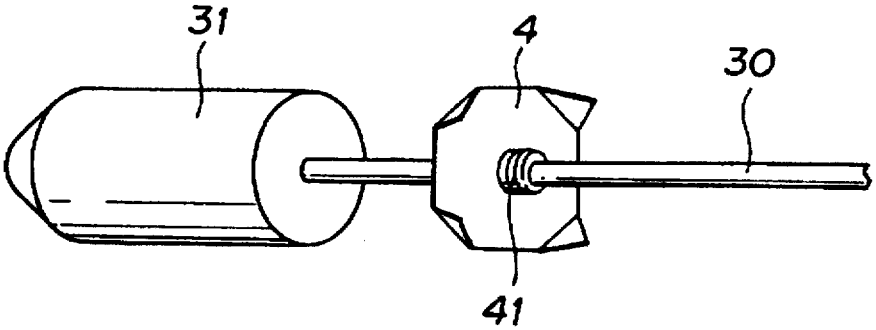
FIG. 2 is a schematic representation of the holding part of the discharge lamp shown in FIG. 1.

FIG. 2 shows a state in which the holding part 4 and the anode 31 are mounted on lead pin 30. In front of and behind holding part 4, the lead 30 is wound with a molybdenum spiral 41 having a diameter of roughly 1.0 mm, and in this way, the position of the lead relative to the holding part 4 is fixed. The holding part 4 is bent on each edge, or at the corners as shown in FIG. 2. These bent edge areas contact with the inside of the robe arm 2 producing an elastic force by which the holding part is secured on the inside of the tube arm 2.

Lead 30, in this case, is made, for example, of tungsten and has an outside diameter of roughly 4 mm. The holding part 4 has an opening with a diameter which is somewhat greater than the outside diameter of lead 30. Holding part 4 is, for example, a square plate with a thickness of roughly 0.1 mm and a side length of 14 mm. Between each side of the holding part 4 and the inside of the respective tube arm 2, a gas passage is formed of a size which can be set by selecting the amount that the edges/corners are bent. This bending is accomplished in a direction opposite the direction of insertion of the electrode, by which plugging of the holding part 4 into the tube arm 2 is facilitated.

Figure 3:
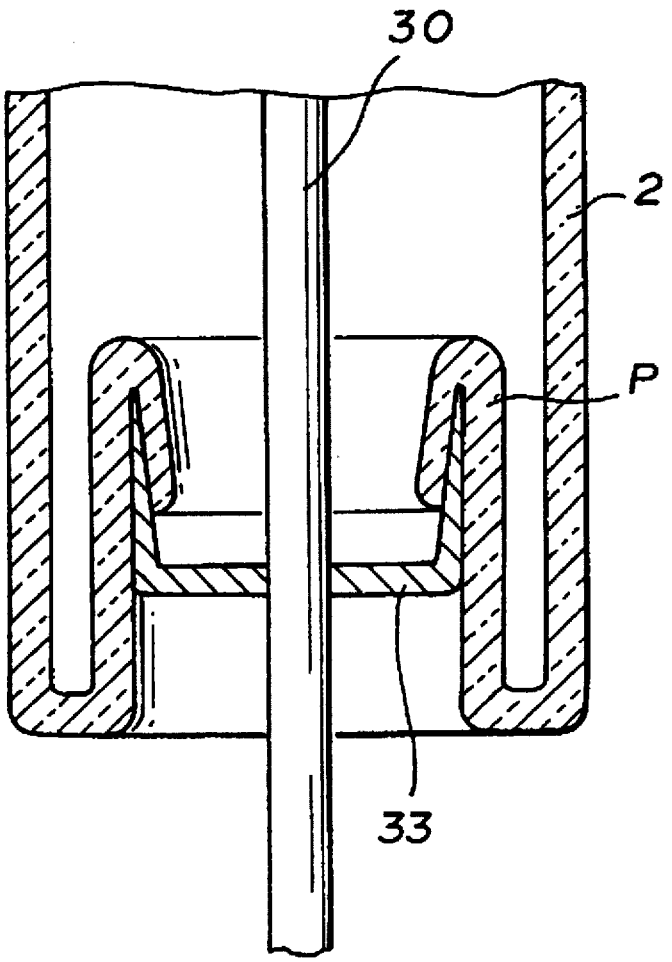
FIG. 3 is a schematic representation of a hermetically sealing part according to the invention.

Next, hermetically sealing part 3 will be described with reference to FIG. 3. A part 33 for hermetic sealing of the ends of the tube arms 2 is made of a metal with a high melting point, for example, molybdenum, and is cup- or pot-shaped. Tip P of the metal pot is ground in the manner of a knife blade and fits into an external recess of tube arm 2. The sides of the metal pot are also surrounded with quartz glass, and in this way a complete hermetic seal is achieved.

Furthermore the bottom of the pot shape can be provided with a protective coating by which oxidation of the metal part 33 can be prevented. This means that, even if the temperature of emission part 1 rises, oxidation of the metal part 33 can be prevented, and thus, the length of the tube arm can be adequately reduced. For example, gold or copper can be used for the protective coating.

Within lamp 10, for example, xenon gas at a pressure of 10 atm. is encapsulated. Luminous operation with 70 V and 2000 W is accomplished, for example.

In the discharge lamp according to the invention, by means of the measure in which a holding part 4 with an extremely simple configuration is arranged, processing of the holding part 4 and installation of the holding part 4 within the lamp 10 are simple to obtain.

Furthermore, by means of the measure in which in the emission part 1 is free of any gas tube residue, projection of a shadow of the gas tube residue onto an irradiated surface is prevented.

Moreover, the process for holding the lead pin by a material with a high melting point is not limited only to use of a metal part, and can, of course, a process can also be used in which glasses with different melting points are gradually joined and welding to the lead pin. It is to be understood that although a preferred embodiment of the invention has been described, various other embodiments and variations may occur to those skilled in the art. Any such other embodiments and variations which fall within the scope and spirit of the present invention are intended to be covered by the following claims.

What we claim is:

1. A discharge lamp with an emission part having a roughly spherical external shape and tube arms connected to opposite sides of the emission part, hermetically sealing parts being provided on an end of each tube and and an electrical lead extending through each hermetically sealing part from the outside, parallel to a longitudinal axis of the tube arm, and an electrode on an inner tip of each lead within the emission part to form a pair of opposed, spaced apart electrodes; wherein a plate-shaped holding part is positioned in each said tube and in proximity to the emission part, said holding part being made of a metal with a high melting point; wherein each holding part is arranged approximately perpendicularly to a respective lead which extends therethrough, the holding part comprising a means for holding the respective lead in a manner properly positioning a respective one of the electrodes.

2. A discharge lamp according to claim 1, wherein the plate-shaped holding part has a polygonal shape with corner points which engage an inner side of a respective one of the tube arms; and wherein a gas passage is formed through a gap between each side of the holding part and the inner side of the respective tube arm.

3. Discharge lamp according to claim 2, wherein each corner of the polygonal shape of the holding part is bent towards the hermetically sealing part; and wherein the bent corner resiliently engages the inner side of the respective tube arm.

4. Discharge lamp according to claim 1, wherein a helical, lead-holding part is positioned at each side of the plate-shaped holding part, the lead extending therethrough.

* * * * *